United States Patent [19]

Harbauer

[11] Patent Number: 4,467,300

[45] Date of Patent: Aug. 21, 1984

[54] ELECTROMAGNETIC SWITCHING APPARATUS

[75] Inventor: Werner Harbauer, Schwandorf, Fed. Rep. of Germany

[73] Assignee: Siemens Aktiengesellschaft, Munich, Fed. Rep. of Germany

[21] Appl. No.: 374,058

[22] Filed: May 3, 1982

[30] Foreign Application Priority Data

May 6, 1981 [DE] Fed. Rep. of Germany ..... 3117914

[51] Int. Cl.[3] ..... H01H 51/08

[52] U.S. Cl. ..... 335/131; 335/17

[58] Field of Search ..... 335/131, 17, 132; 200/67 PK, DIG. 42

[56] References Cited

FOREIGN PATENT DOCUMENTS 963170 5/1957 Fed. Rep. of Germany .
1590211 6/1970 Fed. Rep. of Germany .
7116559 4/1971 Fed. Rep. of Germany .
7230068 8/1972 Fed. Rep. of Germany .
7327169 7/1973 Fed. Rep. of Germany .
1446875 8/1976 United Kingdom .

*Primary Examiner*—Harold Broome
*Attorney, Agent, or Firm*—Kenyon & Kenyon

[57] ABSTRACT

An electromagnetic switching apparatus having a switch position indicator is disclosed. The switch position indicator is in functional connection with the contact carrier and protrudes beyond the cover of the switching apparatus in at least one switch position. The switch position indicator is coupled to the contact carrier by apparatus such that the switch position indicator travels a greater distance than the movable contact carrier in going from at least one switch position to another. Thereby, an unequivocal switch position indication can be obtained, particularly in an open contact condition which satisfies switch disconnect function conditions, thereby making the switching apparatus useful as a disconnect switch.

9 Claims, 7 Drawing Figures

ELECTROMAGNETIC SWITCHING APPARATUS

BACKGROUND OF THE INVENTION

The present invention relates to an electromagnetic switching apparatus which includes a switch position indicator.

DE-GM No. 73 27 169 discloses an electromagnetic switching apparatus having a switch position indicator connected integrally to the contact carrier. British Patent Specification No. 1,446,875 discloses an electromagnetic switching apparatus having a switch position indicator which is spring-loaded away from the indicating position and which is taken along directly by the contact carrier after it has traversed a certain distance. While in the electromagnetic switching apparatus of DE-GM No. 73 27 169, a direct indication of the position of the contact carrier is ensured by the switch position indicator, the position of the switch position indicator does not unequivocally indicate the switch position of the switching apparatus in all cases since the travel distances of contact carriers are often relatively small. The switching apparatus of British Patent Specification No. 1,446,875 suffers from the same drawback which is aggravated since the switch position indicator remains stationary over a portion of the travel distance of the contact carrier. Additionally, the switching apparatus of the British patent specification suffers from the further drawback that direct coupling is not provided between the switch position indicator and the contact carrier so that a jammed switch position indicator could signal the off position of the switching apparatus even though the apparatus is switched on.

OBJECTS AND SUMMARY OF THE INVENTION

It is an object of the present invention to provide in switching apparatus of the above-type, switch position indicator means which indicate unequivocally at least one position of the switching apparatus.

It is another object of the present invention to provide in switching apparatus of the above type, means for effecting a disconnect condition of the switching apparatus which is simple and inexpensive.

These and other objects are achieved in accordance with the invention by coupling the switch position indicator to the contact carrier such that the switch position indicator travels a greater distance than the contact carrier in going from at least one switch position to another.

In accordance with one aspect of the invention, the switch position indicator is coupled to the contact carrier by a lever. In a disclosed embodiment, the lever is coupled to the contact carrier transversely to the direction of motion of the contact carrier. While this arrangement requires a certain amount of space it has the advantage that the contact carrier, which is typically restored automatically to a contacts open condition by a back-pressure spring, can be forcibly actuated to the contacts open condition manually.

According to another aspect of the invention, the switch position indicator is coupled to the contact carrier with free play in the direction of movement of the contact carrier such that coupling between the switch position indicator and the contact carrier takes place at one end of the free play only after the contact carrier moves a predetermined distance. The predetermined distance which the contact carrier moves in going from the contacts closed to the contacts open condition of the switching apparatus is selected to insure that the contacts open condition fulfills the disconnect function requirements. According to a disclosed embodiment, the means coupling the switch position indicator to the contact carrier includes a toggle mechanism which, upon movement of the contact carrier beyond the predetermined distance, couples the switch position indicator to the contact carrier at the other end of the free play. The switch position indicator can include a T-shaped extension which is movably received in a rectangular recess of the contact carrier. The distance over which the T-shaped extension can move in the recess determines the free play. A dead-center spring is advantageously coupled between a fixed point and the switch position indicator.

Additional (auxiliary) control contacts, one of which is associated with the switch position indicator, can be provided for monitoring the disconnect function of the switching apparatus. A circuit breaker connected in series with the contacts of the switching apparatus can be provided to take over the disconnect function in the event of a failure of the switching apparatus, particularly when the switching apparatus is used in safety related applications. The state of the additional control contacts indicates the switch condition of the switching apparatus.

According to another aspect of the invention, a pivoted segment indicator is coupled to the switch position indicator to provide a customary on-off indication.

The above and other objects, features, aspects and advantage of the invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Figure 1:
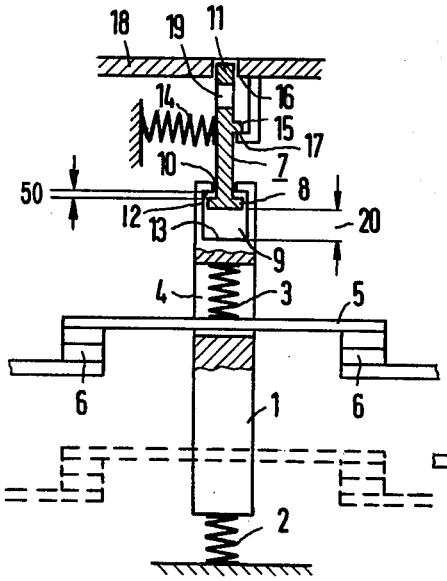
FIG. 1 is a schematic cross-sectional diagram of switching apparatus according to the invention in which a switch position indicator is operated by a toggle mechanism.

Referring first to FIG. 1, an embodiment of an electromagnet switching apparatus according to the invention comprises a contact carrier, specifically a contact bridge carrier 1, which is urged into the off condition or position of the switching apparatus by the back-pressure spring 2 when the magnetic drive (not shown) is de-energized. A contact pressure spring 3 urges a contact bridge 5 movably guided in a slot or window 4 of the contact bridge carrier 1 against stationary contacts 6. Further contact bridges which cooperate with other stationary contacts can be mounted to the contact carrier 1, as indicated by broken lines in FIG. 1.

A switch position indicator 7 projects from a rectangular recess 9 of the contact carrier 1 in which a T-shaped extension 8 of the indicator 7 is movably guided. The rectangular recess 9 has an opening 10 through which the shank 11 of the switch position indicator 7 projects. The walls 12 and 13 of the recess 9 determine the free play of the switch position indicator 7 relative to the contact bridge carrier 1. A beyond-dead-center spring 14, which is braced against the switching apparatus housing, takes up the increased travel distance of the switch position indicator 7 relative to the contact bridge carrier 1. The travel limits for the switch position indicator 7 are determined by a protrusion 15 on the shank 11 of the switch position indicator 7 which cooperates with a stop 16 formed by the apparatus cover 18 and a stop 17 depending from the apparatus cover. A hole 19 in the shank 11 of the indicator 7 allows a padlock to be secured to the indicator so that the switching apparatus can be locked in the off condition.

The switch position indicator 7 is carried with the contact bridge carrier 1 only after the contact bridge carrier 1 has travelled the distance 20. This insures that leakage and air paths between the fixed contacts 6 and the contacts of contact bridge 5 are sufficiently large that the disconnect function is fulfilled. The dead-center spring 14 is moved beyond its dead-center position by the shank 11 of the indicator 7 as the T-shaped extension 8 is engaged by the wall 12 of the recess 9 in the on condition of the switch indicated in FIG. 1. As the contact bridge carrier 1 travels upwardly and traverses the distance 20, the T-shaped extension 8 is engaged by wall 13 of the recess in the bridge contact carrier causing the indicator to jump beyond the upper edge of the cover 18 under the action of the dead-center spring 14 until the protrusion 15 makes contact with the stop 16 indicating a normal opening of the switch. If however the carrier does not traverse the distance 20, indicating that separation was not complete, the T-shaped extension 8 is not engaged by the wall 13 of the recess and the indicator remains in the position shown in FIG. 1 so that the off condition of the switch is not indicated. By contact of the T-shaped extension 8 with the wall 12, the switch position indicator is pulled into the position shown in FIG. 1 when the switching apparatus is switched on.

Figure 1C:
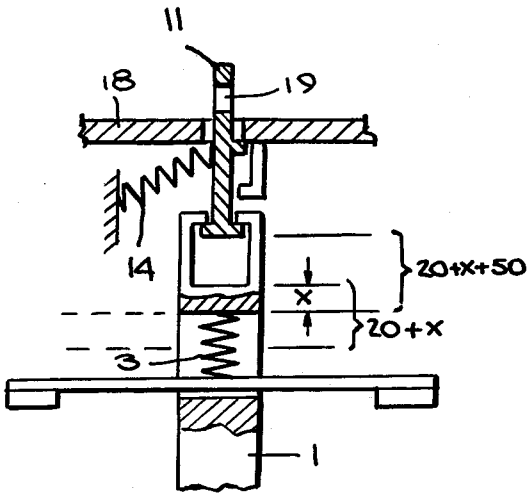
FIGS. 1A, 1B and 1C are views similar to FIG. 1 illustrating the operation of the switching apparatus.
Figure 1B:
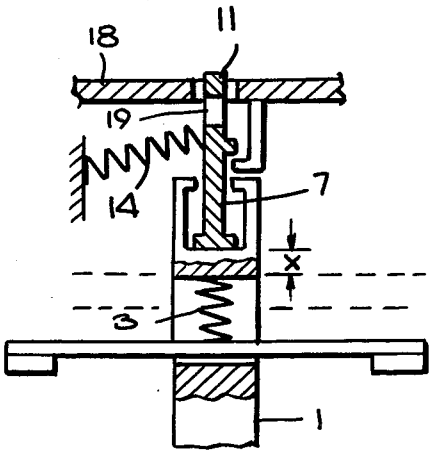
Figure 1A:
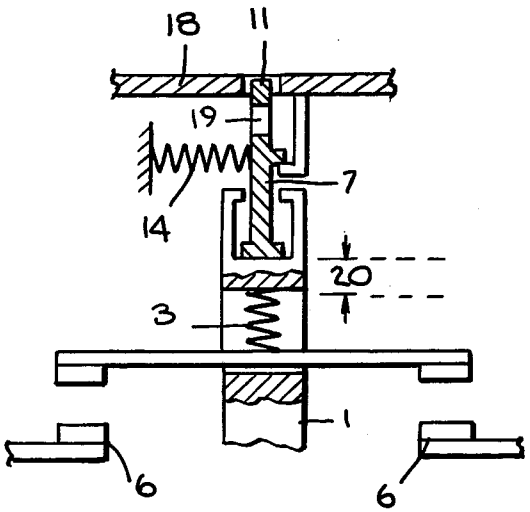

Operation of the switch position indicator of FIG. 1 is illustrated by the sequence shown by FIGS. 1 and 1A–1C. In the closed condition of the contacts, which is indicated in FIG. 1, free play is provided between the switch position indicator 7 and the contact carrier 1 in that spaces are provided in the recess on both sides of the extension 8. One space designated 50 in FIG. 1 lies above the T-shaped extension 8 between the extension and the upper wall 12 of the recess. A particularly large free space designated 20 is provided below the T-shaped extension 8 between the bottom of the extension 8 and the lower wall 13 of the recess. As illustrated in FIG. 1A, when the contact carrier 1 is moved upwardly over the distance 20 to disconnect the contacts, initially the switch position indicator does not move at all due to the free play 20. However, the wall 13 in the recess is now in contact with the T-shaped extension 8. The contact carrier 1 continues to move only a short distance further, designated "x", and then stops, as illustrated in FIG. 1B. This further short distance "x" causes the spring 14 to move past its dead center position. As a result, even though movement of the contact carrier 1 has been stopped, the beyond-dead-center spring 14 moves the switch position indicator 7 while the contact carrier 1 remains stationary, as illustrated in FIG. 1C.

The distance over which the switch position indicator 7 is moved includes the short distance "x" that the switch position indicator 7 is moved by the contact carrier 1 and the free plays designated 50 and 20, while the overall distance moved by the contact carrier 1 includes only the free play 20 and the short distance "x". The indicator moves further than the contact carrier because the contact carrier does not move over the free play designated 50 between the top of extension 8 and the upper wall 12 of the recess while the indicator does.

In the indicating position of the switch position indicator, closing of the switch contacts can be prevented by positioning a lock with its shank in hole 19, thus assuring that the switching apparatus cannot be switched on either mechanically or electrically while for example maintenance is being carried out at a machine controlled by the switching apparatus.

Figure 2:
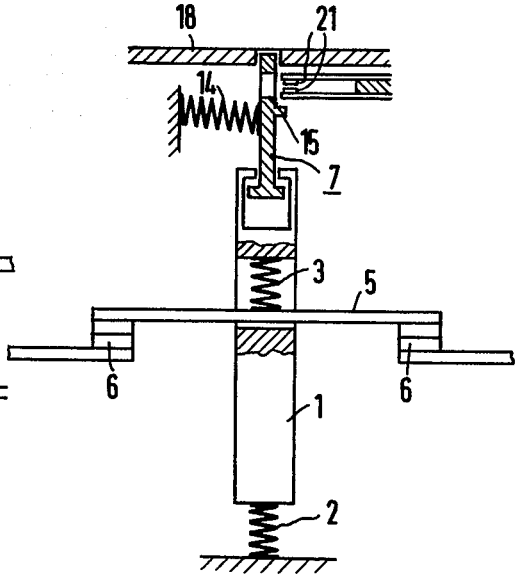
FIG. 2 is a schematic cross-sectional diagram of apparatus similar to that FIG. 1 which includes auxiliary control contacts for monitoring or carrying out disconnect switch functions.

Referring now to FIG. 2, additional auxiliary control contacts 21 are provided which can be actuated by the protrusion 15 of the switch position indicator 7. The auxiliary contacts 21 can be used to monitor the disconnect function. As a safety precaution, a circuit breaker connected in series with the contacts of the switching apparatus can be used to effect a disconnect if the switching apparatus fails. Actuation of the series-connected circuit breaker can then be accomplished by means of the auxiliary control contacts 21 after a predetermined time delay. The auxiliary switches customary in motor contacts are not suited for such a monitoring function.

Figure 3:
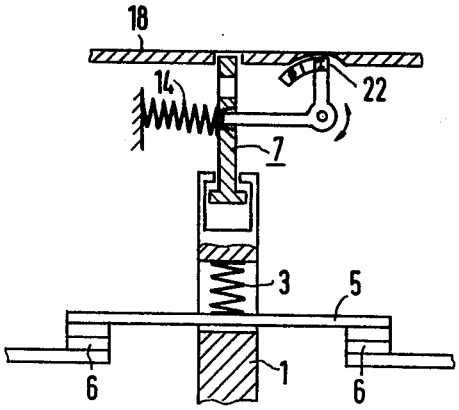
FIG. 3 is a schematic cross-sectional diagram of apparatus similar to that of FIG. 1 with an additional segment switch position indicator.

Referring to FIG. 3, a further indication of the condition of the switching apparatus is provided by the markings O and I on the segment indicator 22. The segment indicator 22 is pivotably mounted and includes an arm enaged by the switch position indictor 7 so that the segment indicator 22 is pivoted by movement of the switch position indicator 7.

Figure 4:
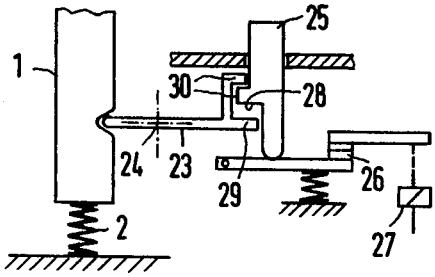
FIG. 4 is a schematic cross-sectional diagram of a portion of switching apparatus according to another embodiment of the invention in which the switch position indicator is coupled via a step-up lever with the contact carrier and an auxiliary contact.

The embodiment depicted in FIG. 4 provides for manual operation while at the same time providing an indication of the condition of the switching apparatus. Manual operation of the switching apparatus is achieved by means of a plunger 25 cooperating with a lever 23 pivoted about the axis 24. Actuation of the plunger 25 also causes a break contact 26 to be opened before the bridge contact carrier 1 disconnects the contacts of the switching apparatus. The break contact 26 is connected in series with a voltage source (not shown) through coil 27 which is used to operate the switching apparatus automatically. Normally, the switching apparatus is held in the off position automatically via the back-pressure spring 2 when coil 27 is not energized, i.e. when contact 26 is open. When the coil is energized, the switching apparatus can be switched to the on position.

The contact bridge carrier can be brought into the off condition of the switching apparatus forcibly by means of the lever 24 and plunger 25 should the switching apparatus jam in the on condition. Depressing plunger 25 causes a shoulder 28 on the plunger to contact the lever extension 29 and thereby pivot the lever and move the bridge carrier 1. The force/distance ratios of the lever can be chosen such that on one hand, the motion of plunger 25, which can be used as an indication, is large enough and exceeds the motion of the contact carrier, and on the other hand, the contact bridge carrier is moved sufficiently far to perform the disconnect function in the electrical sense by separation of the contact bridge 5 from the fixed contacts 6. The opening 19 in the switch position indicator 7 can also be provided in the plunger 25 so that movement of the plunger can be prevented. Extensions 30 at the plunger 25 and the lever 24 prevent pivoting of the lever when the plunger is locked.

The indicating and lever apparatus of FIG. 4 can be provided as a unit which can be retrofitted to existing switching apparatus thereby adding the capabilities of manual operation, unambiguous switch position indication and locking in the off condition to existing switching apparatus. To this end, it is only necessary to consider coupling of the contact bridge carrier to the outside.

The switching apparatus according to the invention insures electrical separation of the contacts in safety circuits with little expense. Furthermore, the utility of the switching apparatus according to the invention is enhanced due to the inability in principle of electronic switching elements, which are being used more frequently, to achieve the electrical separation.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. In electromagnetic switching apparatus including a movable contact carrier movable in one direction toward an open switch condition of the apparatus and in another direction toward a closed switch condition of the apparatus, and a switch position indicator coupled thereto, the improvement comprising means for coupling the switch position indicator to the movable contact carrier such that the switch position indicator can travel a distance greater than the distance travelled by the contact carrier when the contact carrier is moved from at least one of the switch conditions of the switching apparatus to the other switch condition, said means in at least one of the switch conditions coupling the switch position indicator to the contact carrier with limited free play between the switch position indicator and the contact carrier in both directions of movement of the contact carrier such that the coupling between the switch position indicator and the contact carrier takes place at one end of the free play only after the contact carrier has moved a predetermined distance, said means including a toggle mechanism coupled to the switch position indicator which moves the switch position indicator after the contact carrier moves further than said predetermined distance, the overall distance which the switch position indicator is moved by the contact carrier and by the toggle mechanism being greater than the distance moved by the contact carrier.

2. The apparatus according to claim 1 wherein said coupling means comprises a T-shaped extension at one end of the switch position indicator and a rectangular recess in an end of the contact carrier adjacent said T-shaped extension, the T-shaped extension being received in the rectangular recess with free play in both directions of movement of the contact carrier in said at least one switch condition, the distance moved by the indicator including the free play in both directions and the distance moved by the contact carrier including the free play in only one direction.

3. The apparatus according to claim 2 wherein said toggle mechanism comprises a beyond-dead-center spring coupled between the switch position indicator and a fixed point in the switching apparatus.

4. The apparatus according to claim 1 and further comprising additional contacts associated with the switch position indicator, one of said additional contacts being coupled to the switch position indicator to move therewith in at least one direction of movement of the switch position indicator.

5. The apparatus according to claim 1 and further comprising means associated with the switch position indicator for locking it and the contact carrier in a disconnect condition of the switching apparatus.

6. The apparatus according to claim 1 and further comprising a pivotally supported indicator coupled to the switch position indicator and pivoting in response to movement of the switch position indicator.

7. The apparatus according to claim 1 wherein said at least one switch condition is the closed switch condition and the predetermined distance is selected to separate the contacts of the switching apparatus sufficiently to achieve a disconnect condition of the apparatus when the contact carrier is moved from a closed switch condition to an open switch condition.

8. The apparatus according to claim 1 wherein the toggle mechanism and the switch position indicator comprise a unit which is coupled to the switching apparatus.

9. The apparatus according to claim 8 wherein the toggle mechanism/switch position indicator unit is laterally coupled to the contact carrier.

* * * * *